United States Patent [19]

Dyess

[11] Patent Number: 4,470,528

[45] Date of Patent: Sep. 11, 1984

[54] SKI TRANSPORT APPARATUS

[76] Inventor: William H. Dyess, 3116 W. Clinton Dr., Phoenix, Ariz. 85029

[21] Appl. No.: 408,246

[22] Filed: Aug. 16, 1982

[51] Int. Cl.[3] ..... A63C 11/02

[52] U.S. Cl. ..... 224/257; 224/901; 224/917; 280/814; 294/147

[58] Field of Search ..... 224/257, 917, 901; 280/814; 294/147, 149, 150; 2/413, 338; 24/68 SK

[56] References Cited

U.S. PATENT DOCUMENTS

| | | | |
|---|---|---|---|
| 2,121,702 | 6/1938 | Larkin | 2/413 |
| 2,821,168 | 1/1958 | Forbes | 2/338 X |
| 3,268,134 | 8/1966 | Baston et al. | 294/150 |
| 3,278,097 | 10/1966 | Duckworth | 294/147 |
| 3,372,438 | 3/1968 | Rinecker | 224/901 |
| 3,731,348 | 5/1973 | Luehne | 280/814 |
| 3,841,542 | 10/1974 | Hogensen, Jr. | 224/917 |
| 3,947,927 | 4/1976 | Rosenthal | 294/147 |
| 3,964,653 | 6/1976 | Strutz | 224/257 |
| 4,002,277 | 1/1977 | Westerholm | 294/147 |
| 4,114,838 | 9/1978 | Knauf | 280/814 |
| 4,221,314 | 9/1980 | Baker, Jr. | 280/814 |

FOREIGN PATENT DOCUMENTS

| | | | |
|---|---|---|---|
| 2501996 | 9/1975 | Fed. Rep. of Germany | 294/147 |
| 7906337 | 8/1979 | Netherlands | 280/814 |

*Primary Examiner*—Stephen Marcus
*Assistant Examiner*—Robert Petrik
*Attorney, Agent, or Firm*—Harry M. Weiss

[57] ABSTRACT

This disclosure relates to a lightweight ski transport apparatus which can bind a pair of skis into a single package and transport the bound skis by use of a strap to be carried by hand or rested upon the shoulder. The apparatus comprises a harness for releasably engaging a pair of skis having padding to be inserted between the pair of skis for protecting one ski from the other, a strap for permitting a person to carry the skis with the attached harness, and a coupling device for releasably coupling the strap to the harness.

7 Claims, 4 Drawing Figures

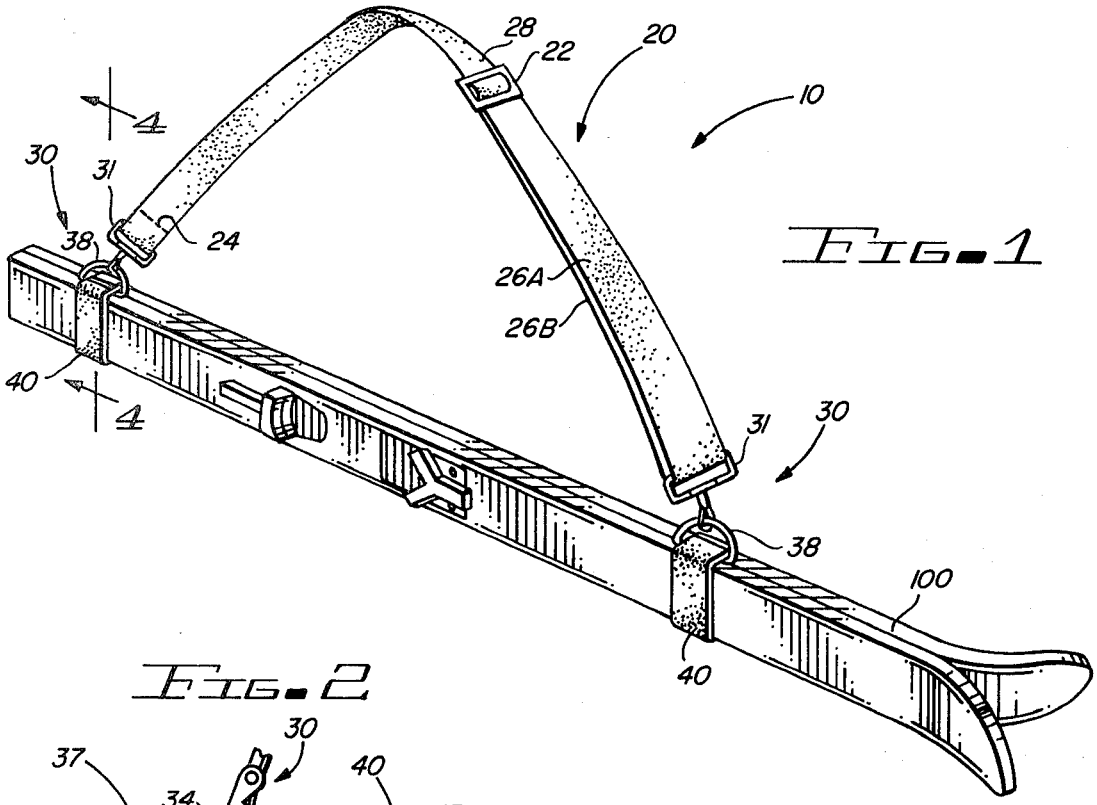
FIG. 1
FIG. 2
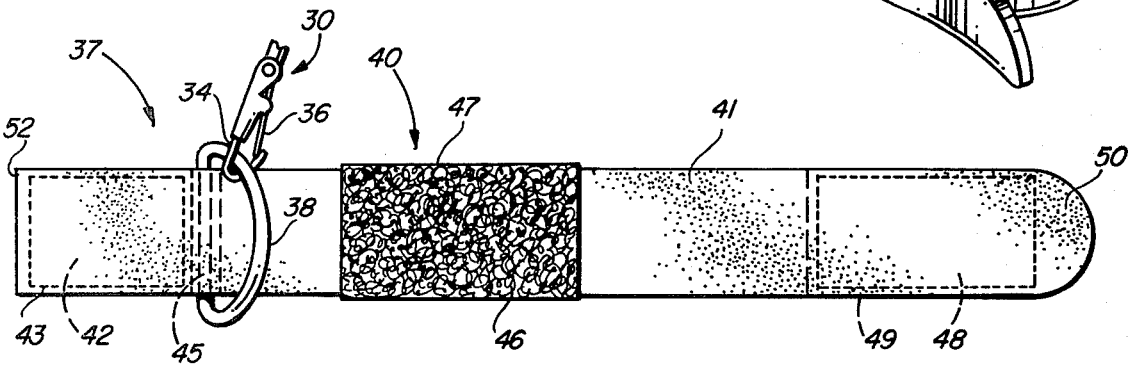
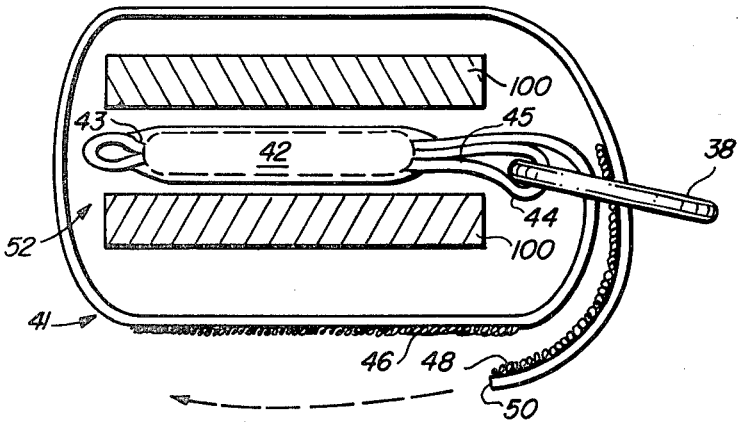
FIG. 3
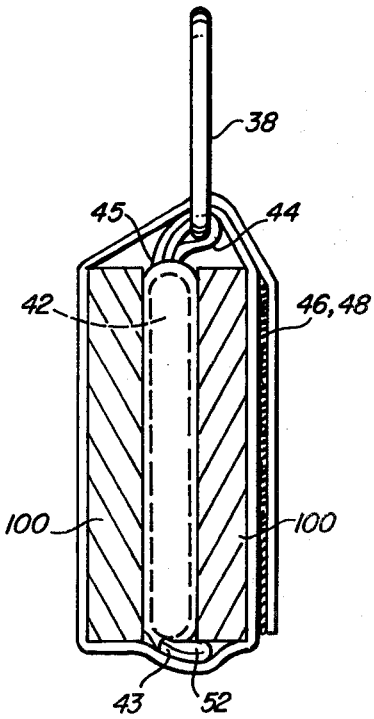
FIG. 4

SKI TRANSPORT APPARATUS

BACKGROUND OF THE INVENTION

1. Field of the Invention

This invention relates generally to ski transport apparatus and, more specifically, to ski transport apparatus used to suspend at least one and preferably both skis from the body of a person carrying the ski or skis.

2. Description of the Prior Art

In the past, skiing, including downhill skiing. cross country skiing, and water skiing, has been enjoyed by multitudes as a form of recreation and competition. Prior to, and subsequent to, the actual wearing of the skis as part of that recreation and competition. the ski or skis had to be transported between a storage location and the hil, snowfield, or body of water to be skied. While various devices were developed to attach the skis to a vehicle, the vehicle commonly had to be parked in an area remote from the actual location of the recreation, or competition. Since skis are usually long, heavy or unwieldly, and thus difficult to transport by hand, a need existed for an apparatus to alleviate the difficulty of manually transporting the skis to the recreation or competition site.

Subsequently, various types of mechanical devices were developed to aid in the manual transport of the skis to the recreation site. Such devices often included a handle or shoulder strap coupled with some type of harness which wrapped around the skis or a bag was used which could fully or partially encase the skis. Although these devices aided in the manual transport of the skis, there remained substantial room for improvement.

The harness straps used to bind the skis, and fastening means attached thereto, of prior art type ski transport devices were often complex or difficult to engage and use, particularly in cold weather. The harness straps were usually rigidly and permanently affixed to the carrying strap, the two straps often becoming twisted and entangled prior to use. The rigid manner in which these straps were attached also caused strain at the interface between the harness and carrying straps resulting in increased wear and premature failure. Even when these devices would not entangle prior to use, they were often difficult to employ because of their long flimsy structure. Also, this prior art apparatus commonly would lie on the ground when the harness straps were being fastened, thereby collecting dirt and moisture etc. This not only made the prior art ski transport devices sloppy and inconvenient to employ, but the collection of moisture etc. on the straps would again increase the chances for premature failure of the straps and components.

Additionally, the harness straps of prior art devices would not always securely hold or bind the skis, permitting the skis to slide while in the harness straps thereby causing discomfort to the skiing enthusiast while transporting the skis, and possibly causing scratching and denting of the ski surface. Furthermore, these prior art type devices required the skis to be bound in a flat manner, the bottoms of each ski coming into contact with each other when compressed together during the binding process. Such a binding method would flatten the natural arc of the skis and scratch the edges and bottom surface of the skis thereby making the skis defective and the skiing process more difficult and less enjoyable.

A corresponding need existed for a portable, compact ski transport apparatus which could more effectively bind the skis during storage or transport. A further need existed for a ski transport apparatus which was more durable, would not entangle or otherwise be difficult to engage or use, and would provide a high level of performance over an increased life cycle.

BRIEF DESCRIPTION OF THE DRAWINGS

FIG. 1 is a perspective view of the ski transport apparatus of the present invention engaging a pair of skis.

FIG. 2 is a planar view of the top surface of an unfolded harness strap of the apparatus shown in FIG. 1;

FIG. 3 is a side view (with the skis in section) of the harness strap of FIG. 2 disclosing how it is wrapped around a pair of skis; and FIG. 4 is a sectional view taken along the line 4—4 of FIG. 1 in which the harness strap is fully closed around the skis and suspended for coupling to a carrying strap.

SUMMARY OF THE INVENTION

In accordance with one embodiment of this invention, it is an object to provide an improved ski transport apparatus useful for carrying at least one ski, but preferably both skis.

It is another object of this invention to provide an improved ski transport apparatus which is light in weight and compactly stores when not in use.

It is still another object of this invention to provide an improved ski transport apparatus which will securely hold the skis in place during storage or transport without scratching, marring or otherwise damaging the skis.

It is yet another object of the invention to provide an improved ski transport apparatus which is essentially tangle proof and ready for use with a minimum of effort even in cold weather.

It is further object of this invention to provide an improved ski transport apparatus which is durable and which will provide a high level of performance over a substantial life cycle.

DESCRIPTION OF THE PREFERRED EMBODIMENT

In accordance with one embodiment of this invention, a ski transport apparatus for carrying a pair of skis is disclosed which comprises a harness means for releasably engaging the skis, adjustable strap means coupled to the harness means for permitting a person to carry the skis with the attached harness means, and a coupling means connected to the harness means and to the adjustable strap means for releasably coupling the harness means to the strap means. The harness means comprises a belt with at least one pair of quick-attach, quick-detach fastening strips thereon, padding means for protecting the skis from damage while bound, and means connected to the belt for permitting attachment to the coupling means. The attachment means preferably is a closed ring stitched to the belt. The coupling means is preferably a hook and lock mechanism attached to the strap means and is releasably attached to the ring thereby creating a releasably coupling of the harness means to the strap means. The harness means wraps around the skis through the ring, the padding means being positioned between the skis, and is securely fastened when the pair of fastening strips come into contact.

The foregoing and other objects, features, and advantages will be apparent from the following, more particular description of the preferred embodiment of the invention as illustrated in the accompanying drawings.

Referring to FIG. 1, a ski transport apparatus is generally designated by reference number 10 and is shown here engaging a pair of skis 100. The component parts of the ski transport apparatus include a strap means 20, harness means 40 (a pair of which are shown) and coupling means 30 for coupling the strap means 20 to the harness means 40.

The adjustable strap means 20 includes a durable strap 28 constructed of a seat belt-type material and an adjusting means 22, such as a buckle device, as shown, slidably attached to the strap 28. The length of the strap means 20 is adjusted by sliding the buckle device or adjusting means 22 along the strap 28 thereby increasing the length of doubled up strap portions 26A and 26B, and correspondingly shortening the length of the total strap means 20.

The coupling means 30 is comprised of an elongated ring 31 attached to end portions of the adjustable strap means and a hook 34 (see FIG. 2) and lock 36 (see FIG. 2) mechanism. The hook 34 and lock 36 are part of a coupling member 37 (see FIG. 2).

One of the elongated rings 31 is attached at manufacture by placing it through the far end (single strap portion) of the strap 28. The strap 28 then overlaps the elongated ring 31 so as to form a stitched loop 24. The other elongated ring 31 is contained in the loop created by the doubled up straps 26A and 26B.

Referring to FIGS. 1 and 2, the coupling means 30 is shown to be releasably coupled to an attaching means 38, such as a closed ring rotatably attached to the harness means 40. The hook 34 of the coupling means 30 is passed through the attaching means or closed ring 38 and is coupled to the ring 38 by the lock or locking arm 36. The coupling means 30 permits a flexible and rotatable interface between the harness means 40 and the strap means 20 as the coupling means 30 is free to rotate around the attaching means 38 to any desired position. The ski transport apparatus 10, and the skis 100 held therein, can thus be transported with greater comfort because of the reduced twisting and strain resulting from the rotatable connections in this apparatus. This decreased strain will also increase the useful life of the ski transport apparatus 10 as it is less likely to prematurely wear at the connecting points.

The strap means 20 completely detaches from the harness means 40 when the locking arm 36 is depressed thereby permitting the hook 34 to disengage the attaching means 38. The harness means 40 can thus be used independently of the strap means if so desired. The disengaged harness means 40 are especially useful when it is desired to bind the skis 100 for storage prior to manual transport, such as when the skis 100 are being transported in a ski rack (not shown) on a vehicle (not shown). It will also be much easier to use the harness means 40 to bind the skis 100 before transporting the skis from the recreation site back to the vehicle or storage area without the strap means 20 attached. This is so because the rather awkward strap means 20 will not obstruct the binding process or be dragged through the elements during the binding process. This not only makes the apparatus less sloppy and more convenient to employ, but again decreases the chance of excessive wear or premature failure that continual exposure to moisture and dirt can cause over a period of time. When it is desired to manually transport the skis 100, the strap means 20 is simply recoupled to the harness means 40 and carried off. The ski transport apparatus 10 may be folded up and easily pocketed by the skier or can be stored in some small compartment when not in use. The coupling means 30 may, alternatively, be attached to the belt loops of the skier or otherwise wrapped around the waist when not in use, if so desired.

The harness means 40 includes a belt 41 of essentially the same material as that of the strap 28, with at least one pair of complementary quick-attach, quick-detach fastening strips such as VELCRO strips 46 and 48 (see FIG. 2). One such VELCRO strip 46 is securely stitched along the outer boundary 47 to the top side of the belt 41 and the other VELCRO strip 48 is stitched along the outer boundary 49 to the underside of the right end portion 50 of the belt 41.

Referring to FIGS. 2 and 3, the left end portion 52 of the belt 41 is folded over and through the ring 38 which has a portion stitched into the belt 41 thus forming a loop 44 (see FIG. 3) which contains the ring 38. A padding means, such as a hollow rubber tube 42, is folded up within the left end portion 52 of the belt 41. The belt 41 is doubled back and out through the ring 38, the padding means 42 being permanently stitched 43 and 45 into the fold thus formed in the belt 41. The stitching 45 also preserves the loop 44 and the resulting rotatable connection between the ring 38 and belt 41.

Referring to FIGS. 3 and 4, the harness means 40 operate to securely bind the pair of skis 100 by wrapping the belt 41 around the skis 100 and through the ring 38. The belt 41 is tightened around the skis 100 and the portion of the quick-attach, quick-detach fastening means 46 on the top side of the belt 41 is fastened to the complementary portion of the quick-attach, quick-detach fastening means 48 on the underside thereby binding the skis 100. The padding means 42 is extremely critical because it is positioned as part of the harness means 40 to rest between the pair of skis 100 when the harness means 40 is fastened about the skis 100. Thus, the padding means 42 provides a soft separation between the pair of skis 100 thereby preventing damage to each ski. The soft separation between the skis 100 provided by this inventive ski transport apparatus 10 represents a significant improvement over prior art type devices which forced the skis 100 into contact with each other during the binding process. The soft separation helps preserve the natural arc, bottom surface, and edges of the skis 100 while the skis 100 are bound, a well maintained ski being essential for proper skiing enjoyment. The harness means 40 also serve to prevent the skis 100 from sliding during transport as such sliding often causes discomfort to the carrier and some scratching of the ski surface. The padding means 42 compresses slightly between the skis 100 when the skis are forced closer together when the belt 41 is tightened, thereby more securely holding the skis 100 in place during transport. This arrangement is additionally advantageous because it does not require an exceedingly tight wrap of the belt 41 around the skis which can cause some scratching of the ski surface and excessive strain on the belt 41 and the fastening means 46 and 48 used to keep this exceedingly tight wrap.

While the invention has been particularly shown and described with reference to the preferred embodiment thereof, it will be understood by those skilled in the art that various changes and mofifications can be made in both form and details without departing from the spirit and scope of the invention which is limited only by the appended claims.

What is claimed is:

1. A ski transport apparatus for carrying a pair of skis comprising, in combination:

harness means for releasably engaging said skis; one end portion of said harness means including a single unitary harness belt means, at least one end portion of said belt means being doubled back upon itself for forming a second belt loop proximate one end portion of said harness means and a first belt loop operably disposed in the opposite direction slightly over one ski width therefrom, said harness means further including padding means operatively disposed proximate said doubled back portions between said belt loops and within said harness means, for providing a protective contact between the bottom surfaces of the skis;

carrying strap means operatively coupled to said harness means for permitting a person to carry said skis in any one of several positions with said attached harness means; and coupling means for removeably connecting and unconnecting said harness means to said strap means.

2. The ski transport apparatus of claim 1 wherein said coupling means includes a ring member having a semi-circular shape with a semi-circular arc portion having distal ends and a relatively straight portion operatively coupled between the distal ends of the arc portion, the one end portion of said belt means passing over said straight portion and through said ring member before being doubled back to form said first loop extending beyond said padding means, said one end portion of said belt means being redoubled back for forming said second loop at said one end portion of said harness means, the intermediate overlapping portions of said belt means formed by doubling and redoubling back over itself operatively housing said padding means therebetween, said harness means including padding fastening means for operatively securing said padding means within that portion of said belt means between said first and second loops.

3. The ski transport apparatus of claim 1 wherein said belt means includes:

ring means operatively carried by said first loop for operatively coupling to said carrying strap means; and a pair of quick-attach, quick-detach fastening means attached to said belt means for releasably holding said belt means in a tight wrap around said ski.

4. The ski transport apparatus of claim 1 wherein a pair of skis are provided, said first end portion of said belt means containing said padding means being operably disposed between said pair of skis, the length of said padded portion of said harness means disposed between the first and second extending loop portions is approximately equal to the width of said skis.

5. The ski transport apparatus of claim 3 wherein said pair of quick-attach, quick-detach belt fastening means having one of said pair being operably disposed on the top side of said belt means proximate the intermediate portion of said belt means.

6. The ski transport apparatus of claim 4 wherein said padding means comprises a soft, substantially compressable flexible padding located within a portion of said belt means proximate one end portion thereof.

7. The ski transport apparatus of claim 6 wherein said padding means comprises at least one hollow rubber tubular foam portion.

* * * * *